United States Patent [19]

Spann et al.

[11] 4,210,317

[45] Jul. 1, 1980

[54] APPARATUS FOR SUPPORTING AND POSITIONING THE ARM AND SHOULDER

[76] Inventors: Donald C. Spann, 5 Ferncreek Ct., Greenville, S.C. 30067; Dorothy Sherry, 3135 Indian Hills Dr., Marietta, Ga. 30067

[21] Appl. No.: 34,962

[22] Filed: May 1, 1979

[51] Int. Cl.[2] ..... A61G 13/00

[52] U.S. Cl. ..... 269/328

[58] Field of Search ..... 269/328; 128/77, 133, 128/134; 5/431, 443, 436

[56] References Cited

U.S. PATENT DOCUMENTS

| | | | |
|---|---|---|---|
| 2,910,259 | 10/1959 | Johnson | 269/328 X |
| 3,242,923 | 3/1966 | Jacoby | 128/133 |
| 3,295,518 | 1/1967 | Hazlewood et al. | 269/328 X |
| 3,901,228 | 8/1975 | Brown | 128/133 |
| 3,939,829 | 2/1976 | Spann | 128/133 |
| 3,946,451 | 3/1976 | Spann | 5/327 R |

*Primary Examiner*—Robert C. Watson

*Attorney, Agent, or Firm*—Bailey, Dority & Flint

[57] ABSTRACT

Apparatus is disclosed for properly supporting and positioning a patient's arm and shoulder when placed in a prone position on an operating table for laminectomy surgical procedures and the like after correct positioning of the spine is accomplished. The apparatus includes a resilient arm cradle having a trough which supports the arm distally from the shoulders to adjacent the patient's wrist which flexes to support the arm naturally bent and in which the weight of the arm is supported over a greater surface area in a manner which is particularly advantageous in preventing pressure points on the elbow. The apparatus further includes an axilla cuff which fits under the axilla and has an exterior contour which interfaces with the shape of the trough of the arm cradle in such a manner that a desired rotation of the shoulder is maintained so as to preclude brachial plexus damage.

12 Claims, 5 Drawing Figures

APPARATUS FOR SUPPORTING AND POSITIONING THE ARM AND SHOULDER

BACKGROUND OF THE INVENTION

When positioning a patient prone on an operating table for laminectomy procedures, the proper support and positioning of the extremeties after the spine has been correctly positioned is a problem to which considerable attention need be given. Typically, in surgical procedures such as laminectomy the patient is placed in a prone position on an operating table, and the arms of the patient are placed and supported on padded armboards which are generally level with the operating table. Assorted padding is utilized to support the axilla. The arm naturally tends to curve and all armboards are made with a straight centerline. The armboard tends to preclude optimum support of the arm and unless adequate support is provided under the axilla, brachial plexus damage can become a significant problem.

SUMMARY OF THE INVENTION

It has been found according to the invention, that the arms of a patient placed prone on an operating room table for laminectomy procedures may be properly positioned and supported thereon by apparatus which includes an arm cradle having a V-shaped trough constructed of resilient deformable material and hinge means allowing the cradle to bend laterally in a horizontal plane so as to support the arm in its natural curved position from the shoulder to adjacent the wrist. An axilla cuff is provided for surrounding and supporting the axilla area having an exterior contour which interfaces with the V-shaped trough of the cradle so as to maintain the shoulder in a properly rotated position such as to reduce the possibility of brachial plexus damage.

Accordingly, an important object of the present invention is to provide apparatus for properly supporting and positioning the arm and shoulder of a patient placed prone on an operating table for laminectomy procedures.

Another important object of the present invention is to provide apparatus for properly supporting and positioning an arm of a patient during laminectomy procedures and the like wherein the shoulder is maintained in a properly rotated position such as to reduce any damage to the brachial plexus.

Yet another important object of the present invention is to provide apparatus for properly supporting and positioning the arm of the patient during laminectomy procedures wherein the weight of the arm is distributed over a greater surface area thus reducing the weight carried per unit area.

Yet another important object of the present invention is to provide an arm cradle device for supporting and positioning the arm of a patient when in a prone position such as during laminectomy procedures wherein the cradle includes a trough which is shaped to reduce the possibility of ulnar nerve damage by effectively preventing pressure points on the elbow.

Yet another important object of the present invention is to provide apparatus for properly supporting and positioning a patient placed prone on an operating table for laminectomy procedures wherein the arm is properly positioned in a natural curve configuration and a cuff device is provided for gripping the arm adjacent the shoulder in such a manner that the shoulder is maintained in a desired rotated position.

BRIEF DESCRIPTION OF THE DRAWING

The construction designed to carry out the invention will be hereinafter described, together with other features thereof.

The invention will be more readily understood from a reading of the following specification and by reference to the accompanying drawing forming a part thereof, wherein an example of the invention is shown and wherein.

DESCRIPTION OF A PREFERRED EMBODIMENT

Figure 1:
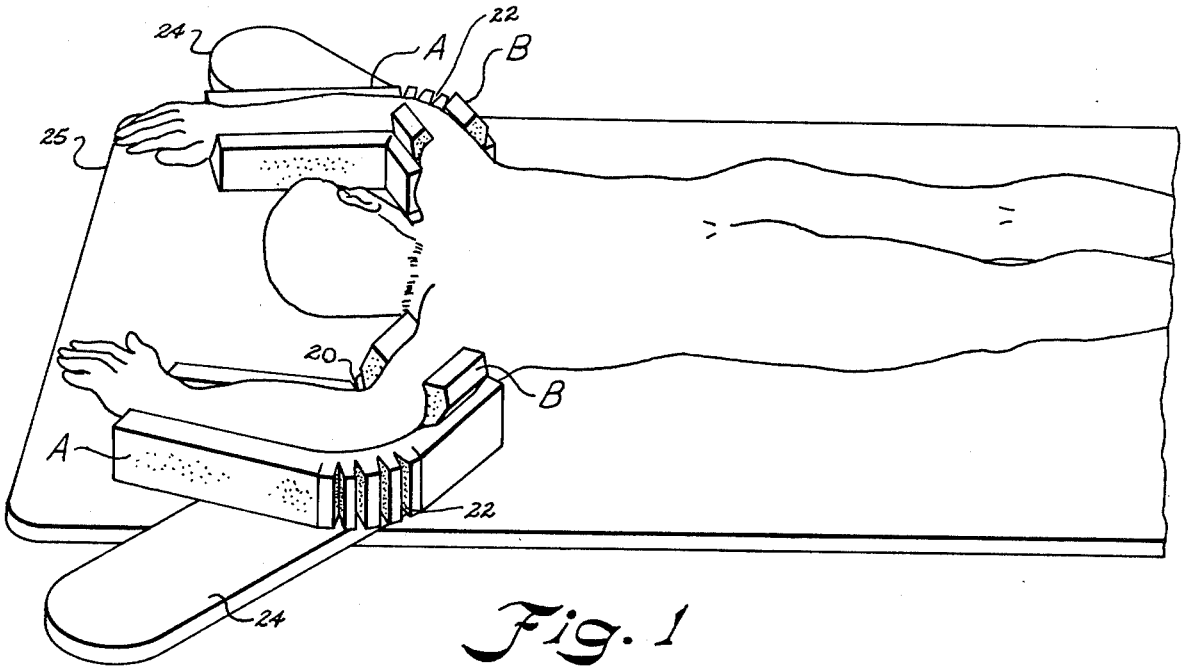
FIG. 1 is a perspective view illustrating a patient placed in a prone position on an operating table such as during laminectomy procedures wherein the patient is shown with its arms and shoulders properly supported in position by apparatus according to the invention.
Figure 2:
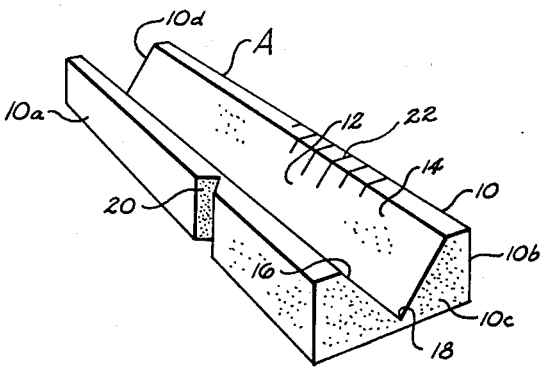
FIG. 2 is a perspective view of an arm cradle device constructed according to the invention.
Figure 3:
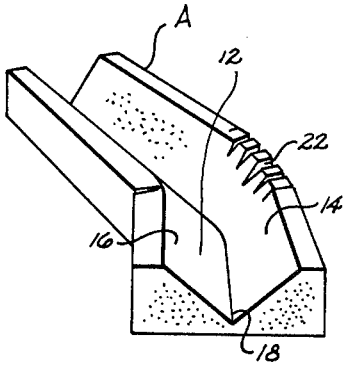
FIG. 3 is a perspective view illustrating an arm cradle device according to the invention curved when supporting an arm in a normal bent position.

The drawing illustrates apparatus for positioning the extremities of a patient placed in a prone position on an operating table during laminectomy and the like procedures including an arm cradle means A for properly supporting and positioning an arm of the patient including an elongated block having a support base for supporting the arm cradle stably on a planar surface. An elongated trough is formed in the block means for cradling and positioning the arm having an enlarged weight supporting surface affording reduced force per unit area against the arm supported thereon. Cuff means is provided having a support portion for receiving and resiliently gripping the axilla portion of the arm adjacent the shoulder. The cuff means includes an exterior contoured surface receivable in the trough of the arm cradle means and interfacing with the trough in an interlocking manner for maintaining the shoulder in a properly rotated position.

Referring in more detail to the drawing, an arm cradle device A is illustrated as including an elongated block 10 of resilient deformable material such as a high density polyurethane foam material wherein a trough 12 is formed having opposing side surfaces 14 and 16 in the form an inverted "V" which converge to an apex portion 18. The block includes planar side walls **10*a* and 10*b* and end walls 10*c* and 10*d*. A planar bottom surface provides a stable support base. The arm cradle is of sufficient length to support the arm distally from the shoulder to a point approximately adjacent the patient's wrist. The angled sides 14 and 16 tend to wedge the arm into the desired angle and position and present an enlarged weight supporting surface and generally provide continuous and more arm contact than if the arm were supported by a flat surface. The arm cradle trough thus tends to distribute the arm weight over a greater surface thus reducing weight carried or force exerted per unit area of support surface. The trough shape as illustrated, tends to reduce the possibility of ulnar nerve damage by effectively preventing pressure points on the elbow and can best be seen in FIG. 1** wherein the elbow is supported in the trough when in a curved configuration.

As illustrated, hinge means are provided in the cradle in the form of a vertical notched out area 20 in sidewall 10*a* and vertical slits 22 formed in an opposing sidewall 10*b* of the cradle device wherein the cradle device and trough are allowed to flex or bend laterally in a horizontal plane so as to provide a natural support for the arm in its naturally curved position when the patient is prone as illustrated. The arm cradle A may be utilized in conjunction with the padded arms 24 of a typical operating table 25 wherein the arm cradle may be stably supported across a portion of the operating table and across a portion of the padded arm supports presenting more natural and proper positioning of the arm.

Figure 4:
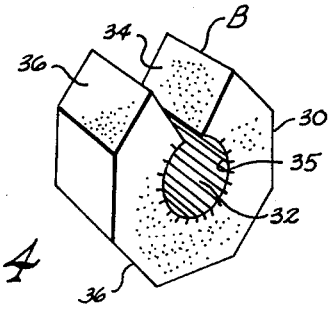
FIGS. 4 and 5 are perspective views of an axilla cuff device constructed according to the invention.
Figure 5:
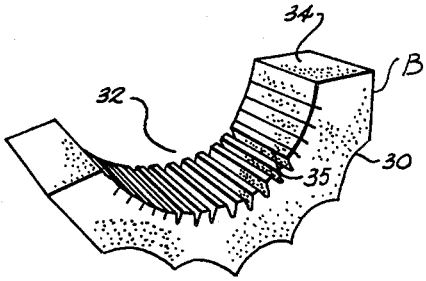

The axilla cuff device B, as illustrated in FIG. 4, includes a block of any suitable resilient deformable material such as high density polyurethane foam, and includes a support portion in the form of a hollow cut-out core 32 in which the arm adjacent the axilla is substantially enclosed and cradled. An open top slot 34 is cut through the outer rim of the axilla cuff for receiving the arm therethrough for placement in the central support portion of the cradle. The central supporting portion 32 of the axilla cuff includes longitudinal slits 35 formed along the length of the supporting surfaces to aid in the dispersion of pressure on the arm in this area. The exterior of the axilla cuff includes a plurality of planar surfaces 36 which give the axilla cuff an exterior contour which interfaces with the shape of trough 12 of the cradle arm in such a manner that the cuff is interlocked therewith and the shoulder of the patient is maintained in a desired rotated position such as to preclude brachial plexus damage. Proper rotation and positioning of the shoulder, of course, will be carried out by a qualified medical personnel prior to the surgical procedures by first placing the axilla cuff around the axilla area, as best seen in FIG. 1, and then placing the remainder of the arm and the axilla cuff in the trough of the arm cradle.

Thus, it can be seen that an advantageous construction can be had for properly positioning and supporting a patient's arm when placed in a prone position on an operating table such as during laminectomy procedures. The arm cradle is hinged so as to allow the arm to bend and assume its naturally curved position and the supporting trough of the cradle device allows the weight of the arm to be spread over a much greater surface area heretofore and reduce the possibility of ulnar nerve damage by effectively eliminating pressure points on the elbow. An axilla cuff device, having a high coefficient of friction, grips the arm at the axilla and interlocks with the arm cradle to properly position the shoulder in a desired rotated position so as to prevent the possibility of brachial plexus damage.

While a preferred embodiment of the invention has been described using specific terms, such description is for illustrative purposes only, and it is to be understood that changes and variations may be made without departing from the spirit or scope of the following claims.

What is claimed is:

1. Apparatus for positioning the extremities of a patient placed in a prone position on an operating table during laminectomy and the like procedures comprising:

arm cradle means for properly supporting and positioning an arm of said patient including elongated block means having a support base for stably supporting said arm cradle;

an elongated trough formed in said block means cradling and positioning said arm including an enlarged contoured weight supporting surface affording reduced force per unit area against said arm supported thereon;

cuff means having a support portion for receiving and resiliently gripping a portion of said arm adjacent the axilla thereof; and said cuff means including an exterior contoured surface receivable in said trough of said arm cradle means and interfacing with said countour of said trough surface in an interlocking manner for maintaining said shoulder in a properly rotated position.

2. The apparatus of claim 1 including hinge means formed in said block means enabling said arm cradle to bend laterally and support and position said arm in a naturally curved configuration.

3. The apparatus of claim 1 wherein said weight supporting surface of said trough includes a pair of opposing surfaces.

4. The apparatus of claim 3 wherein said opposing surfaces are inclined to one another and converge from a spread apart arm receiving portion to a narrowed portion wherein the arm is received and supported against said opposing surfaces.

5. The apparatus of claim 1 including pressure distribution means formed within the support portion of said cuff for dispersing pressure against the axilla area of said arm.

6. The apparatus of claim 1 wherein said weight supporting surface of said trough includes a pair of angled opposing side surfaces and said exterior contour surface of said cuff device includes planar surfaces interfacing with said angled surfaces of said trough in an interlocking manner.

7. Apparatus for positioning the extremities of a patient placed in a prone position on an operating table during laminectomy and the like procedures comprising:

arm cradle means for properly supporting and positioning an arm of said patient including a contoured weight supporting surface providing a continuous enlarged arm contact surface; and cuff means including a support portion for receiving and resiliently gripping a substantial portion of said arm adjacent the shoulder and an exterior contoured surface generally corresponding with said contoured weight supporting surface of said arm cradle means to interlock therewith against rotation for maintaining said shoulder in a properly rotated position.

8. The apparatus of claim 7 wherein said exterior contoured surface of said cuff means is planar.

9. The apparatus of claim 7 wherein said arm cradle means and cuff means are constructed from resilient deformable material whereby the coefficient of friction therebetween affords interlocking between said contoured surfaces.

10. Apparatus for positioning the extremities of a patient placed in a prone position on an operating table during laminectomy and the like procedures comprising:

arm cradle means for properly supporting and positioning an arm of said patient including elongated block means having a support base for stably supporting said arm cradle;

an elongated resilient cradle portion formed in said block means for supporting and positioning said arm having a resilient deformable weight supporting surface; and hinge means formed in said block means enabling said arm cradle to bend laterally and support and position said arm in a naturally curved configuration.

11. The apparatus of claim 10 wherein said supporting surface of said cradle portion includes a pair of opposing surfaces converging upwardly to define an open arm receiving top portion.

12. The apparatus of claim 10 including cuff means having a support portion for receiving and resiliently gripping a portion of said arm adjacent the axilla, and said cuff means and cradle support portion having an exterior contoured and coefficient of friction therebetween so that said cuff means may be received in said cradle portion in an interlocking manner for maintaining said shoulder in a properly rotated position.

* * * * *